US009290302B2

(12) United States Patent
Horn

(10) Patent No.: US 9,290,302 B2
(45) Date of Patent: Mar. 22, 2016

(54) MEDICINE DISPENSING RECORD SYSTEM

(71) Applicant: Kimberlee Ann Horn, Romney, IN (US)

(72) Inventor: Kimberlee Ann Horn, Romney, IN (US)

( * ) Notice: Subject to any disclaimer, the term of this patent is extended or adjusted under 35 U.S.C. 154(b) by 371 days.

(21) Appl. No.: 13/752,471

(22) Filed: Jan. 29, 2013

(65) Prior Publication Data

US 2014/0209489 A1 Jul. 31, 2014

(51) Int. Cl.

| | |
|---|---|
| ***B65D 83/04*** | (2006.01) |
| ***B65D 25/20*** | (2006.01) |
| ***A61J 7/04*** | (2006.01) |
| *A61J 1/03* | (2006.01) |

(52) U.S. Cl.

CPC ..... *B65D 25/20* (2013.01); *A61J 7/0481* (2013.01); *A61J 1/03* (2013.01); *A61J 7/0418* (2015.05); *A61J 2205/30* (2013.01)

(58) Field of Classification Search

CPC ..... A61J 1/03; A61J 7/04; A61J 2205/30; A61J 2007/0418; B65D 83/04

USPC ..... 206/224, 459.1, 459.5, 460, 534, 540, 206/38; 40/310; 215/228, 230, 383, 384, 215/390; 220/87.1

See application file for complete search history.

(56) References Cited

U.S. PATENT DOCUMENTS

| | | | | |
|---|---|---|---|---|
| 1,554,191 | A * | 9/1925 | Alexander | 40/310 |
| 2,892,595 | A * | 6/1959 | Tupper | 206/540 |
| 4,405,045 | A * | 9/1983 | Villa-Real | 206/534 |
| 4,973,177 | A * | 11/1990 | Rose | 206/224 |
| 5,011,032 | A * | 4/1991 | Rollman | 215/230 |
| 5,105,949 | A * | 4/1992 | Blair | 206/534 |
| 6,976,628 | B2 | 12/2005 | Krupa | |
| 7,240,793 | B2 | 7/2007 | McBain | |
| 8,033,409 | B2 * | 10/2011 | Lindemann | 220/4.21 |
| 2003/0061750 | A1 | 4/2003 | Bernier et al. | |
| 2005/0092647 | A1 | 5/2005 | McBain | |
| 2007/0186452 | A1 | 8/2007 | Hirth | |
| 2008/0210755 | A1 | 9/2008 | Salzarulo | |
| 2010/0072163 | A1 * | 3/2010 | Krause | 215/230 |
| 2012/0138563 | A1 * | 6/2012 | Brumfield | 215/230 |

* cited by examiner

*Primary Examiner* — Luan K Bui

(74) *Attorney, Agent, or Firm* — James Ray and Assocs

(57) ABSTRACT

A medicine dispensing record system that joins with a medicine container and records and displays content and administration information about a medicine to ensure the proper administration of the medicine. The medicine information that is recorded may be erased and updated when a subsequent dose of medicine is administered. The medicine dispensing system includes an identification portion that affixes to the medicine container and includes a dry-erase surface that provides a receptive and erasable surface for a user to record and review information about a last medicine dose with information such as: time and/or date the last dose was administered, amount of medicine administered, current daily intake amount, contents of the medicine container, scheduled administration of the medicine, and warnings about the medicine. The information displayed on the surface is constantly revised with each subsequent dosage of the medicine with an attached dry-erase marker.

14 Claims, 5 Drawing Sheets

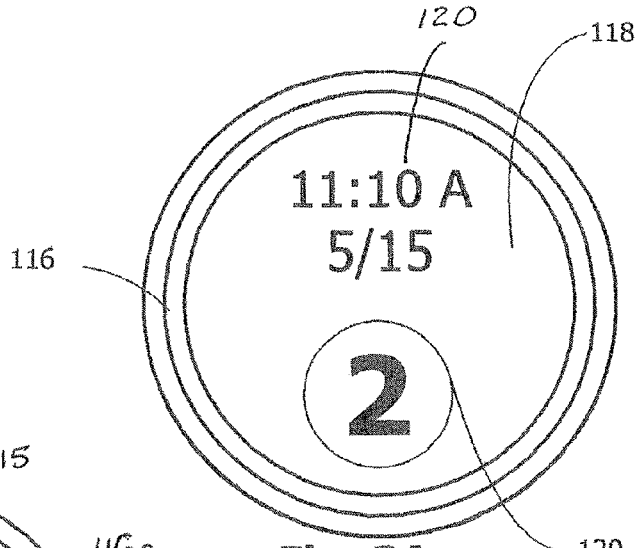
Fig. 3A
Fig. 3B
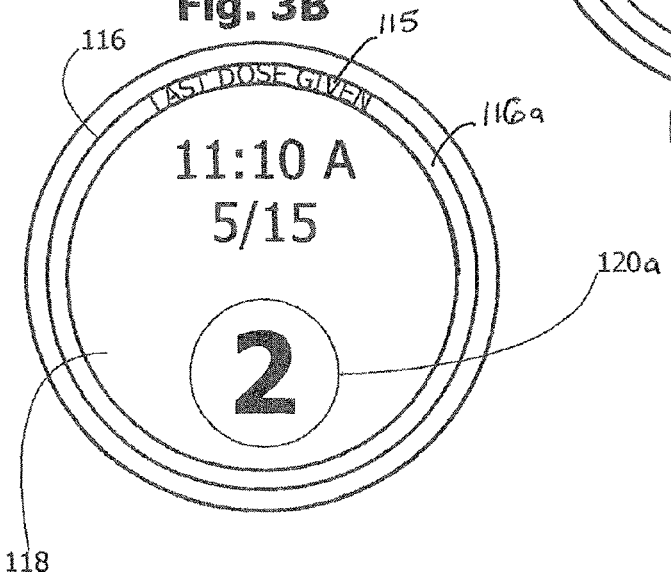
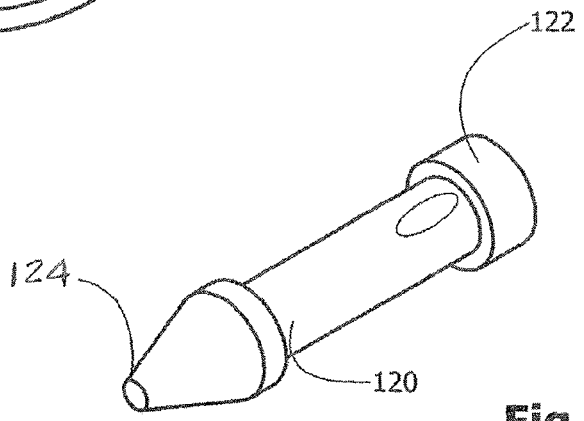
Fig. 4

MEDICINE DISPENSING RECORD SYSTEM

FIELD OF THE INVENTION

The present invention relates generally to a medicine dispensing record system. More specifically, the present invention provides a system that records content and administration information about the medicine to ensure proper administration of the medicine.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, one of the recommendations to reduce medication errors and harm is to use the "five rights of medicine administration": the right patient, the right drug, the right dose, the right route, and the right time. However, the five rights should be accepted as a goal of the medication process not the "be all and end all" of medication safety. It is important to follow the rules of the 5 rights of patient medication administration to keep the patient safe and prevent harm. Medical professional errors often occur in the medical field, and utilizing the five rights points can help to avoid these errors.

It is important for every medical professional to be knowledgeable about the medication being given to the patient. It is not possible for every medical professional to know the drug facts on every drug. To be safe and competent, the medical professional should look up unfamiliar drug information before giving the medication to the patient. The patient has the right to information on the medication, the right to receive the correct medication, and the right to have a medical professional knowledgeable in the medication they are providing. Examples of the five rights of medicine administration may include:

Right Patient—Be sure you have the right patient before administering medication; Ask the patient to state their full name.

Right Medication—Check the bottle's label against the physician's authorization; Be sure they match.

Right Dose—Double check the amount of medication before administering; Be sure the amount to be given is clearly understood.

Right Time—Medication is to be given in substantial compliance with the physician's request; Within one half hour before or after the scheduled time.

Right Route—Designated medical professionals are authorized to administer oral medication only; Do not administer ear, eye, nose drops, topical medication, or injected medication.

Typically, medicine may include a special food or a chemical that makes someone better when they are ill. A lot of medicines are liquid and can be bought in a small bottle. Other medicines may come in pills or capsules. The doctor may tell the patient or caregiver how much medicine to take each day. Most medicines cannot be bought unless a doctor (or other authorized professional) has prescribed the medicine for the patient. Often, the doctor or pharmacist provide specific instructions for administering the medicine, including dosages, quantities, and warnings.

Typically, medicine containers are containers that contain medicine prescribed by doctors. Medicine containers come in different shapes, sizes, and colors. The most common is an orange pill bottle, opaque liquid bottle or a pill box.

Typically, dosage forms are a mixture of active drug components and nondrug components. Depending on the method of administration they come in several types. These are liquid dosage form, solid dosage form and semisolid dosage forms. Various dosage forms may exist for a single particular drug, since different medical conditions can warrant different routes of administration. Additionally, a specific dosage form may be a requirement for certain kinds of drugs, as there may be issues with various factors like chemical stability or pharmacokinetics. The oral and intravenous doses of a medicine may also vary depending on the patient, the strength of the medication, and the severity of the illness.

Even though the above cited medicine dispensing systems address some of the needs of the market, a medicine dispensing record system that effectively records the administration of the medicine after each subsequent dosage is still desired.

SUMMARY OF THE INVENTION

In one embodiment of the present invention, the present invention is directed to a medicine dispensing record system that either permanently affixes to, or detachably attaches to a medicine container and records and displays content and administration information about a medicine to ensure the proper administration of the medicine. The medicine information that is recorded may be erased and updated when a subsequent dose of medicine is administered.

The medicine dispensing record system provides for adaptability within the design to fit virtually any prescription or non-prescription medication bottle or box packaging. A dual-purpose single-molded cap features a lid on one side and the medicine dispensing record system on the opposite side. In one embodiment, an identification portion may serve as a lid on the medicine container to help inhibit the medicine from leaving the medicine container. However, in another embodiment, the identification portion may position onto a lid on the medicine container. Those skilled in the art will recognize that the identification portion may attach to numerous areas of the medicine container, including, without limitation, an opening in the medicine container, a sidewall of the medicine container, and a lid of the medicine container. A perimeter lip extends from the identification portion to form secure bond with the medicine container. The identification portion includes a protruding member that carries an indicia a "Last Dose Given" function. The protruding member orients so that it is visible from the exterior of the medicine container. A marking surface positions on the protruding member for receiving markings. It is on the marking surface that the user may chart, or write down when the last dose of that specific medication was utilized, and in what amount.

In some embodiments, the medicine dispensing record system may include the identification portion that either permanently affixes to, or detachably attaches to the medicine container and includes a marking surface. A perimeter lip extends from the identification portion and allows the identification portion to securely attach to the medicine container through various fasteners, including a threaded cap, a snap lock, and a fastener. The marking surface includes a protruding member that extends from the marking surface for greater visibility and tactile functionality. The protruding member provides a receptive and erasable surface for a user to record and review information about a last medicine dose, including, without limitation, the time and/or date that the last dose was administered and/or current daily intake amount, the amount of medicine administered, the date the dose was administered, contents of the medicine container, scheduled administration of the medicine, and warnings about the medicine. The information displayed on the marking surface allows a user to continue taking the medication safely and appropriately. The medicine information also provides the same reference point used by hospitals for the user when following the regimen set forth by a medical professional.

In some embodiments, the medicine dispensing record system may further include a marking device for convenient and effective marking on the marking surface. The marking device records information that may be erased and updated when a subsequent dose of medicine is administered. The writing device may include an eclectic variety of types and styles, such as a dry erase marker or an invisible marker. The marking device may attach to the side of the medicine container through means such as a Velcro attachment or an adhesive. The marking device is efficacious for marking and erasing an identifier on the marking surface. The identifier may include an erasable ink that marks onto, and erases from the marking surface. In some embodiments, the indicia "Last Dose Given" may be written around the top or sides of the medicine dispensing record system and serve as user instructions to avoid confusion during medication administration.

A first aspect of the present invention provides a medicine dispensing record system for recording information about a medicine and ensuring proper administration of the medicine comprising:

An identification portion, the identification portion being disposed to join with a medicine container, the identification portion comprising a perimeter lip for engaging the medicine container, the identification portion further comprising a protruding member, the protruding member comprising a marking surface for receiving an identifier, the identifier being configured to adhere to the marking surface without binding or being absorbed by the marking surface; and a marking device, the marking device being operable to provide the identifier to the marking surface.

In another aspect of the present invention, the medicine dispensing record system provides for adaptability within the design to fit virtually any prescription or non-prescription medication bottle or box packaging.

In another aspect of the present invention, the identification portion may attach or be a part of the top or sides of the medicine container or package.

In another aspect of the present invention, the identification portion includes a multiplicity of shapes and dimensions for attaching to different medicine containers or medicine packaging.

In another aspect of the present invention, a dual-purpose single-molded cap features a lid on one side and the medicine dispensing record system on the opposite side.

In another aspect of the present invention, the medicine information displayed by the medicine dispensing record system provides the same reference point that hospitals use for the user when following the medicine dosage regimen set forth by a medical professional or package instructions. The information may include, without limitation, the time the last dose was administered and/or the date the last dose was administered, the amount of medicine last administered, the current daily intake amount, contents of the medicine container, scheduled administration of the medicine, and warnings about the medicine. By displaying updated information about the medicine, the effectiveness of the medicine is improved, intricacies of the medicine are known, and confusion about the administration of the medicine is reduced.

In yet another aspect of the present invention, the medicine information may be erased and updated when a subsequent dose of medicine is administered.

In yet another aspect of the present invention, the marking surface is fabricated from a material that is efficacious for marking and erasing a multiplicity of times without binding to or absorbing an identifier such as an erasable ink.

In yet another aspect of the present invention, the marking device includes an identifier that is efficacious in marking the marking surface and erasing from the marking surface.

In yet another aspect of the present invention, the Last Dose Given always refers the user back to the medicine instructions.

In yet another aspect of the present invention, the medicine dispensing record system contains a processor for transmitting, receiving, and digitally displaying the medicine information.

In yet another aspect of the present invention, the medicine dispensing record system contains a dial with preset numbers that the user may orient for displaying the medicine information.

In yet another aspect, in operation, the user would have a malady that required the use of the medicine. The user would receive a container of the medicine, instructions about the medicine and the proper administration of the medicine from a medical professional or medicine container directions. The user would administer the appropriate dosage of the medicine. The medicine dispensing record system would be permanently attached to the medicine container so that the user could view information about the last dose given. The identification portion may be permanently affixed to the medicine container, or may position over an aperture in the medicine container by the user. In one embodiment, the identification portion includes a threaded surface for engaging a threaded aperture of the medicine container. However, in other embodiments, other fasteners may be used, including, without limitation, a snap lock, a pin, and an adhesive fastener. In some embodiments, the identification portion would rotatably secure to the medicine container. However, in other embodiments, other fastening methods may be used. The user would utilize the marking device to mark the time, quantity, and instructions regarding the administration of the medicine. The marking device would inscribe the medicine information onto the marking surface. If limited visibility is a factor, the protruding member could be utilized as a guide to identify the marking surface.

At a predetermined periodic interval, the user would require an additional dosage of the medicine and may detach the identification portion from the medicine container. The user would administer an additional dosage of medicine based on the medicine instructions displayed on the marking surface. The previous medicine instructions would be erased by rubbing. A cloth or hand may be utilized for erasing the medicine instructions. The user would mark new medicine instructions on to the marking surface to reflect the most recent administration of the medicine. Immediately after administering the medicine, the user would mark the time (present) that the dose was given to reflect the most recent administration of the medicine. The process of erasing and adding additional marks onto the marking surface would then be repeated every time a subsequent dosage of medicine was administered.

Accordingly, an objective of the present invention is to help prevent at-home medication errors by educating the general public about the 5 Rights of Medication Administration (Right Patient, Right Drug, Right Dose, Right Route, Right Time).

A further objective of the present invention is to increase the peace of mind for the user by verifying the proper schedule and dosage of the medicine.

A further objective of the present invention is to enable the general public to function as a hospital nurse during medication administration. Charting (either electronically or by writing) immediately after administering a medication helps prevent medication underdosing and overdosing.

A further objective of the present invention is to increase public availability to a low cost medicine dispensing record system due to its simple construction.

A further objective of the present invention is to reduce nationwide short term and long term healthcare costs by encouraging patient compliance and adherence with medication regimens.

A further objective of the present invention is to encourage patient compliance and adherence with medication regimens by "charting" both amount and time the last amount of medication was given on medicine bottles or packaging.

A further objective of the present invention is to reduce patient short term and long term health care costs by including two of the missing 5 Rights (Right Amount, Right Time) medication administration to medication bottles and packaging.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which:

FIGS. 3A and 3B present top views of a marking surface with an identifier, according to an embodiment of the present invention;

FIG. 4 presents a blow up view of the marking device detached from container, according to an embodiment of the present invention;

DETAILED DESCRIPTION OF THE INVENTION

Figure 1:
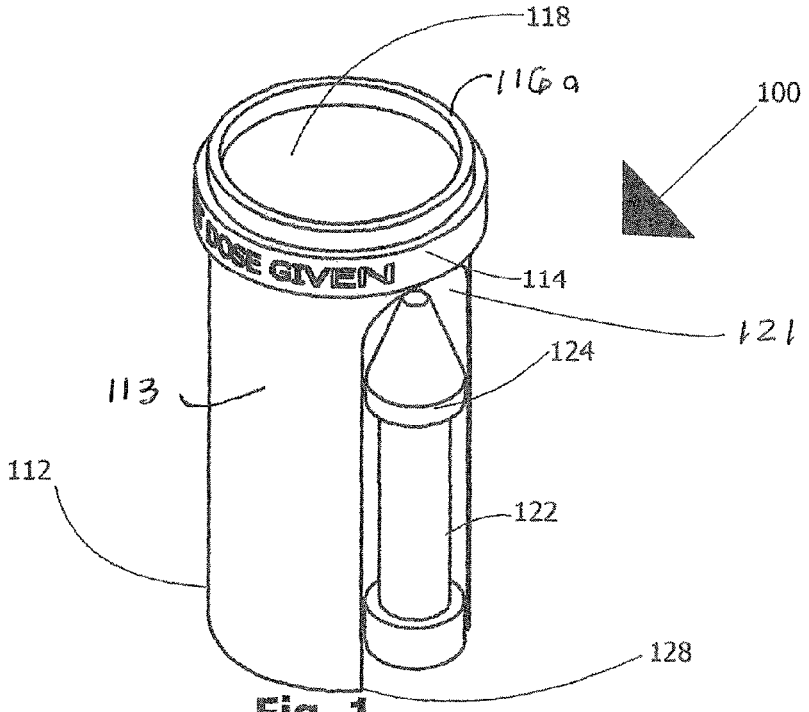
FIG. 1 presents a detailed perspective frontal view of a medicine dispensing record system resting on a tubular medicine container with a marking device attached, according to an embodiment of the present invention.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The instant invention provides a record system, generally designated as 100, for recording information about a substance. The instant invention is illustrated and described in combination with a medicine dispensing container for recording information about the medicine and ensuring proper administration of the medicine is described in FIGS. 1 through 8, although it will be apparent to those skilled in the relevant art that the present invention may be applied to other substances/contents and as such should not be interpreted as a limiting factor of the present invention. Nor should the instant invention be interpreted as a limiting factor applying to only dispending record keeping efforts.

According to one embodiment and multiple views of the present invention, the medicine dispensing record system 100 is an assembly comprising an identification portion 110 being so configured that information about the administration of medicine is recorded or marked thereon with a marking device 122 to be discussed in more details below. The identification portion 110 is disposed to join with a medicine container 112. The identification portion 110 may be dimensioned and sized to attach to a variety of medicine containers 112, including, without limitation, a tubular pill bottle, a liquid medicine bottle, a rectangular or square pill dispenser with one or more internal compartments, rectangular or square box package containing blister packs of medicines like Benadryl or cold medicine, and a cylinder shaped bottle. In one embodiment, exemplified in FIG. 1, the medicine container 112 is illustrated as a conventional prescription medicine container. The identification portion 110 may attach to numerous areas of the medicine container 112, including, without limitation, an opening in the medicine container 112, a sidewall of the medicine container 112, and a lid of the medicine container 112. Those skilled in the art, in light of the present teachings will recognize that the identification portion 110 may be provided as a dual-purpose single-molded cap that features a lid on one side and the medicine dispensing record system 100 on the opposite side for dual purpose functionality. In some embodiments, the identification portion 110 may be permanently glued or a part of the mold of the medicine container 112. However, in other embodiments, the identification portion 110 may snap or slide directly onto a surface 113 of the medicine container 112 or onto the lid or cap covering the open end of the medicine container 112. In one embodiment, the identification portion 110 may secure to the medicine container 112 through a perimeter lip 114. However, in another embodiment, the identification portion 110 secures onto a lid of the medicine container 112. The perimeter lip 114 may engage the medicine container 112. In some embodiments, the perimeter lip 114 may be annular and threaded, designed to rotatably engage a threaded (not shown) on the outer sidewall of the open end in the medicine container 112. In some embodiments, the perimeter lip 114 may be permanently glued or be a part of the mold of the identification portion 110, configured as a cap on the open end of the container 112. However, in other embodiments, the perimeter lip 114 may snap or slide onto the side wall of the open end of the medicine container 112 or onto exterior surface of a cap configured to close the open end of the container 112. Those skilled in the art, in light of the present teachings, will recognize that interior of the perimeter lip 114 may be configured to create a conventional child-proof seal with the open end for inhibiting access to the medicine by children, whereby the identification portion 110 is pressed against the medicine container 112 while simultaneously rotating the identification portion 110 counter clockwise to remove the identification portion 110. However, in other embodiments, the identification portion 110 may snap off or slide off the medicine container 112. The exterior surface of the perimeter lip 114 may be configured to carry indicia 115 depicting "Last Dose Given" identification.

The identification portion 110 may include either a protruding or inset member 116 oriented so that it is visible from the exterior of the medicine container 112. A marking surface 118 is positioned within the protruding or inset member 116 of FIGS. 1-2 for receiving markings or identifier 120 or 120*a*. The significance of the protruding or inset member 116 is in that it provides means for preventing incidental or unintentional erasure of the identifier 120, 120*a* either partially or completely by preventing direct access to the marking surface 118, particularly when the user removes the identification portion 110 to gain access to the contents in the hollow interior of the medicine container 112. It is on the marking surface 118 that the user may chart, or write down when the last dose of that specific medication was utilized, and in what amount. In yet another embodiment, the external surface of the identification portion 110 and/or the external surface of the protruding member 116 carries thereon another indicium or indicia 115 providing the Last Dose Given indication function for the information contained on the marking surface 118; whereby the Last Dose Given information may be viewed and amended without removing the identification portion 110 from the medicine container 112. Those skilled in the art, in light of the present teachings will recognize that the Last Dose Given information always refers the user back to the medicine consumption instructions.

Figure 2:
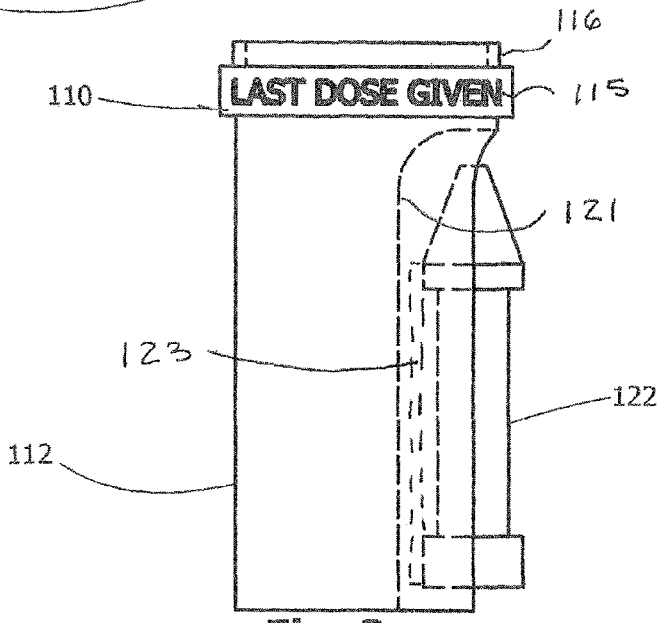
FIG. 2 presents a side view of a medicine dispensing record system positioned over a tubular medicine container with the marking device attached, according to an embodiment of the present invention.

FIG. 2 illustrates an exemplary identification portion 110 that includes the protruding member 116, in accordance with an embodiment of the present invention. In one embodiment, the protruding member 116 may be annular and extend about 1.5 centimeters above the identification portion 110. In some embodiments, the protruding member 116 may assist the visually impaired by providing tactile functionality. The protruding member 116 includes the marking surface 118 for receiving an indicium, indicia or identifier(s) 120. The marking surface 118 provides the area on the medicine container 112 where medicine information is marked, viewed, and erased or removed. It is also contemplated that the indicia 115 or any other indicia may be disposed on the edge surface 116*a* of the protruding member 116. In other embodiments, the protruding member 116 prevents or substantially limits direct contact with the marking surface 115 so that the user will not accidentally erase the indicia 120 either partially or completely when handling the medicine container 112 or the identification portion 110.

In some embodiments, the medicine information may include, without limitation, the time and/or date the last dose was administered, the amount the last dose of medicine was administered, the current daily intake amount, contents of the medicine container 112, scheduled administration of the medicine, and warnings about the medicine, as best shown in FIGS. 3A and 3B. The medicine information in FIG. 3B includes multiple indicia or identifiers 120 that are hand written. In some embodiments the marking surface 118 may be fabricated from a material that does not adhere or bind to the identifier 120, including, without limitation, a dry-erase surface, a melamine surface, porcelain, painted steel, and hardened laminate. The marking surface 118 is preferably configured to be reused a multiplicity of times to reflect subsequent dosages of the medicine. The identifier 120 is configured to adhere to the marking surface 118 without binding and/or being absorbed by the marking surface 118. In some embodiments, the identifier 120 may include, without limitation, a dry-wipe marker ink, an erasable ink, eraser mate inks, and toluene and xylene based inks. In some embodiments, the identifier 120 may be a nontoxic erasable ink that easily and quickly erases from the marking surface 118. In yet another embodiment, the identifier 120 may be provided as a peelable label 120*a*. In either embodiment, the user of the record system 100 reapplies any subsequent new identifier 120 without concern for intermeshing the new identifier 120 with a previously applied identifier 120, providing that the user first removes the previously applied identifier 120.

FIG. 4 illustrates an exemplary marking device 122 shown previously in FIGS. 1-2, in accordance with an embodiment of the present invention. The marking device 122 is operable to provide the identifier 120 on to the marking surface 118. The marking device 122 may include a multiplicity of colors and shapes. In some embodiments, the marking device 122 is an erasable marker that attaches to the medicine container 112 with Velcro® type fastener 123 or any other suitable means. A detachable cap 124 may cap the marking device 122 for protecting the identifier 120 from drying and preventing the identifier from adhering to other surfaces. Preferably, the container 112 includes a surface indentation 121, including without limitations cavity, depression or channel, sized and shaped to at least partially receive the marking device 122. Although, it is also contemplated that the marking device 122 may be attached directly to the exterior surface 113 of the medicine container 112 void of any such indentation 121.

Figure 5:
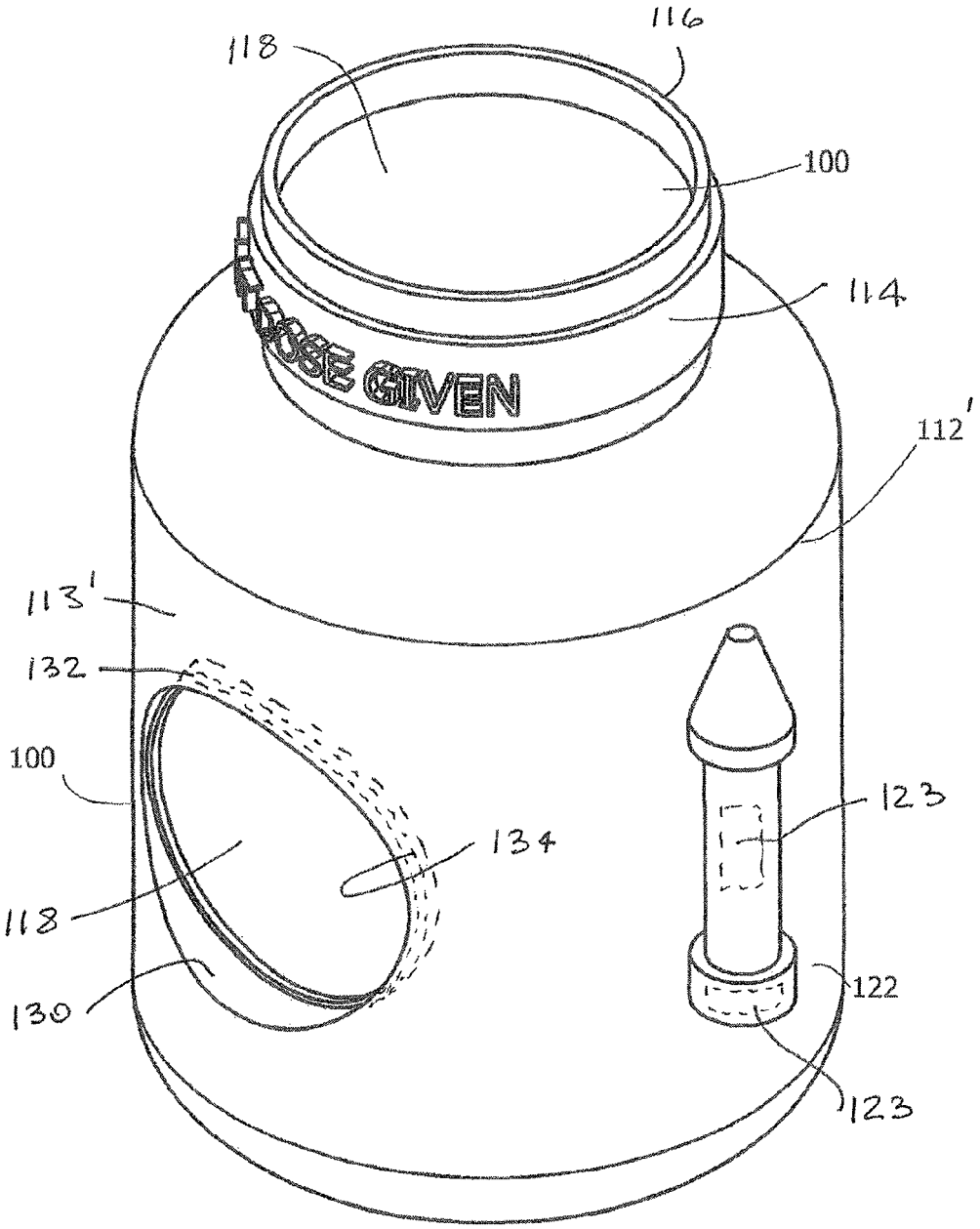
FIG. 5 presents a detailed perspective view of the medicine dispensing record system affixed to the side of the medicine container, according to an embodiment of the present invention.

FIG. 5 illustrates an exemplary medicine dispensing record system 100 that rests along a sidewall of the medicine container 112' illustrated as a conventional container for holding vitamins and the like medicines or liquids, such as antibiotics or cough and cold medicines. In some embodiments, a permanent medicine dispensing record system 100 may be located on an external sidewall of the medicine container 112'. In this manner, the medicine information may be made more visible and accessible. In yet another embodiment, the medicine dispensing record system 100 may include an indentation 130 in the exterior surface 113' of the sidewall of the container 112' with a flat adhesive 132 that affixes the marking surface 118 to the surface 134 of the indentation 130. In this manner, the marking surface 118 may essentially be the entire system. It must be further noted, that the indentation 130 may be so inset into the hollow interior of the medicine container 112' that its resulting side surface defines the above referenced member 116 being inset into a surface of the medicine container 112" but having an upper edge thereof disposed above the marking surface 118 for the purpose of preventing or substantially limiting direct contact with the marking surface 115. A normal lid or cap 112*a* may be utilized to selectively close the open end of the container 112' so as to contain the medicine inside the medicine container 112'. The perimeter lip 114 may be permanently glued or be a part of the mold of the identification portion 110, configured as a cap 112*a* on the open end of the container 112. The perimeter lip 114 may also snap or slide onto the side wall of the open end of the medicine container 112 or onto exterior surface of the cap 112*a* configured to close the open end of the container 112'. A marking device 122 may then attach to the medicine container 112' by some means, for example such as the above described hook and loop fastener 123. In yet another embodiment, multiple medicine dispensing record systems 100 may be utilized on one medicine container 112'. A variety of instructions, warnings, and dosage information may be included when more than one marking surface 118 is made available. In some embodiments, the medicine container 112' may include any number of medicine dispensing record systems 100.

In one alternative embodiment, the medicine dispensing record system 100 includes a processor for displaying, receiving, and transmitting medicine information between a medical facility and the medicine dispensing record system 100. In some embodiments, the medicine dispensing record system 100 may also include a transmitter and a receiver for communicating medicine information between a medical facility and the medicine dispensing record system 100. Those skilled in the art, in light of the present teachings, will recognize that the marking surface 118 may include a digital display device for showing real time medicine information. In this manner, manually erasing the medicine information may not be necessary. A data input device may allow the user to input information about the medicine, including, without limitation, the time and/or date the last dose was administered, the amount of medicine administered, the current daily intake amount, contents of the medicine container 112, scheduled administration of the medicine, and warnings about the medicine. In some embodiments, the administration of the medicine may be inputted, and the medical facility may be made aware of the dosage and administration of the medicine. The medical facility may then transmit information, advice, and warnings about the administration of the medicine when appropriate. In another embodiment, the medicine dispensing record system 100 includes an audio device for alerting about the proper scheduled administration of the medicine. The medical facility may initiate the audio device to remind the user to administer the medicine at recommended times. However, in another embodiment, the medicine dispensing record system 100 may be programmed to automatically alert the user about scheduled administration of the medicine at predetermined time intervals.

Figure 6:
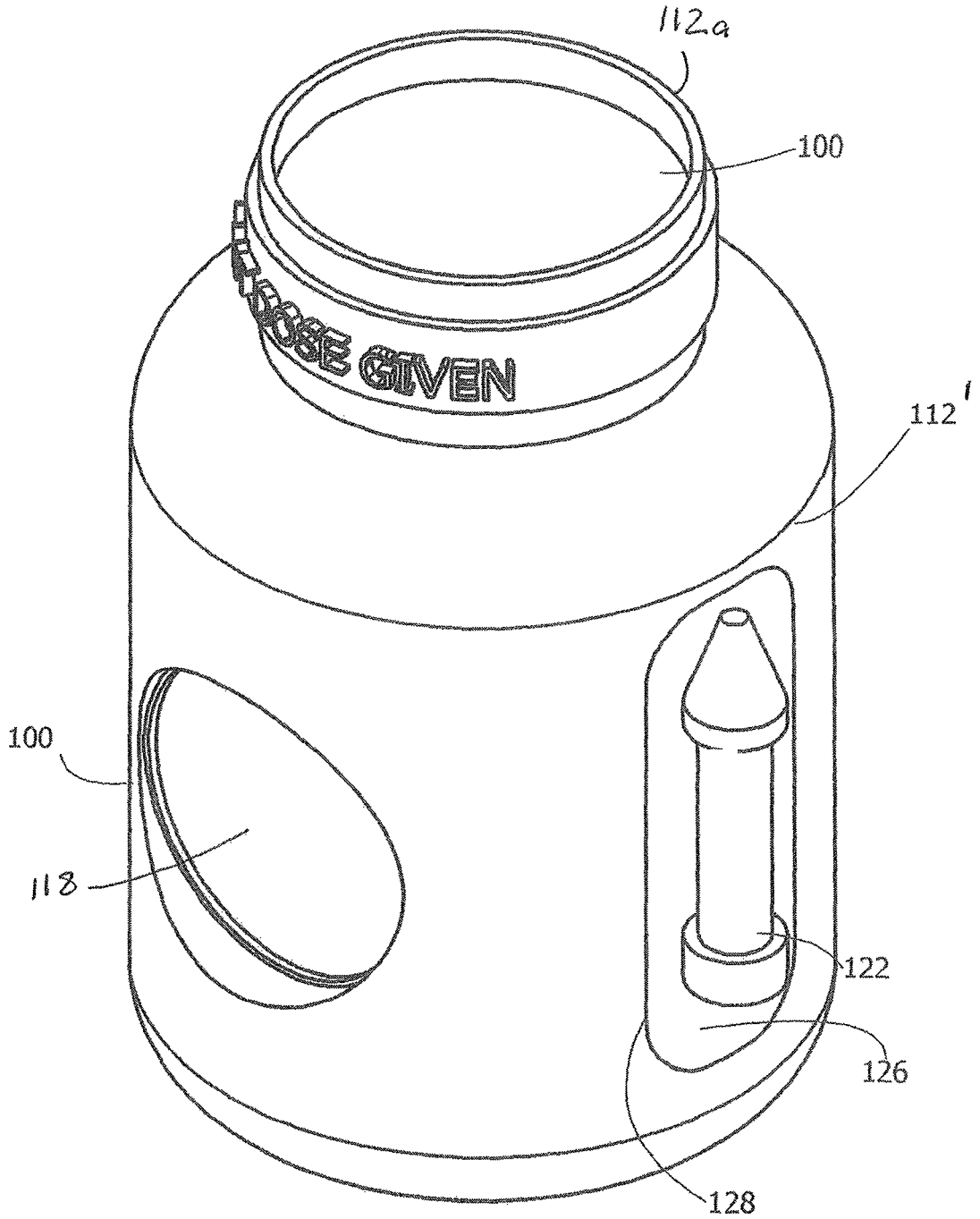
FIG. 6 presents a detailed perspective view of the medicine container with an indentation positioned along a longitudinal axis of a medicine container, according to an embodiment of the present invention.

FIG. 6 illustrates one alternative embodiment of the medicine dispensing record system 100, in accordance with an embodiment of the present invention. The medicine container 112' may be sized and dimensioned to have a cylindrical shape. The medicine container 112' may include a surface indentation 121, including without limitations cavity, depression or channel 126 along a longitudinal axis 128. The inset, such as cavity, depression or channel, 126 may be sufficiently wide and deep to securely receive and grip the marking device 122, whereby the marking device 122 snaps into the channel 126. The marking device 122 preferably forms a flush surface with the medicine container 112' when positioned inside the cavity, depression or channel 126. In this manner, the medicine container 112' forms a smooth surface along an external perimeter sidewall, and the marking device 122 does not extend beyond the external perimeter sidewall of the medicine container 112'. Those skilled in the art will recognize that an external fastener, such as Velcro, may not be necessitated for securing the marking device 122' within the cavity, depression or channel 126. In yet another embodiment, a magnet may align along the cavity, depression or channel 126 or the longitudinal axis 128 for attaching the marking device 122 to the medicine container 112'.

Those skilled in the art, in light of the present teachings, may recognize that the medicine container 112 may comprise a multiplicity of shapes and dimensions to accommodate different medicines.

Figure 7:
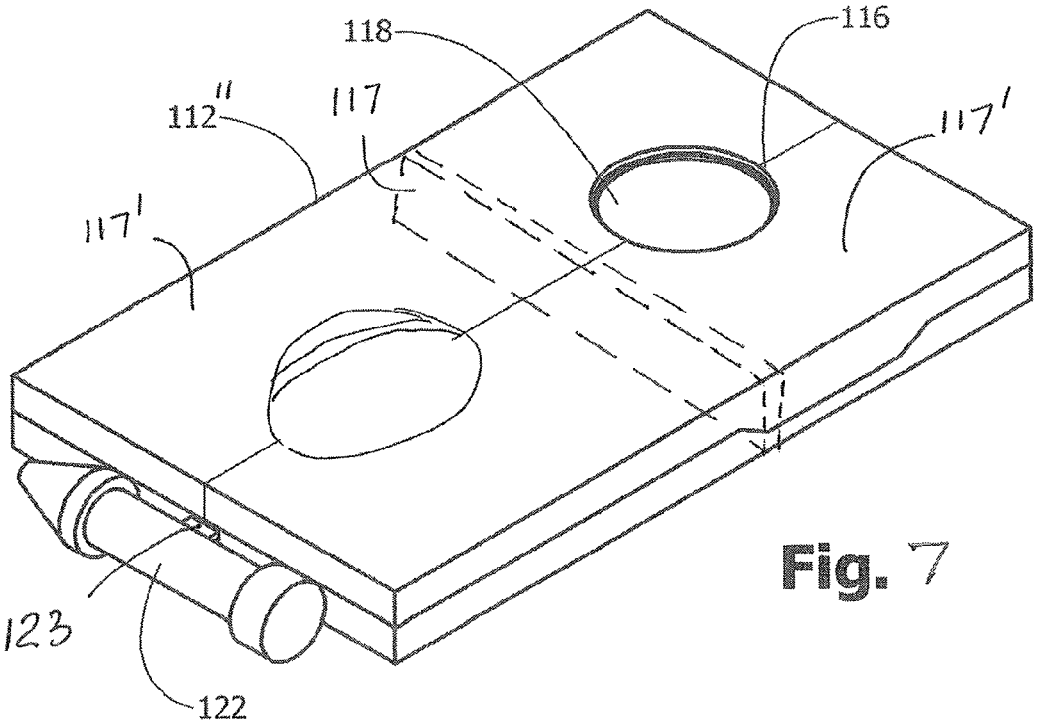
FIG. 7 presents a detailed perspective frontal view of a medicine dispensing record system affixed to the side of a rectangular medicine container with a marking device attached, according to an embodiment of the present invention.
Figure 8:
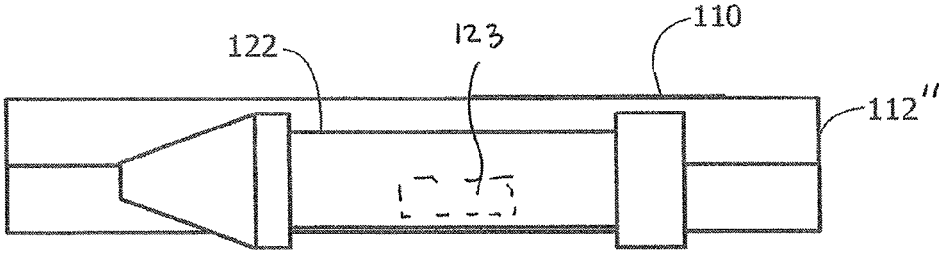
FIG. 8 presents a side view of a medicine dispensing record system affixed to the side of a rectangular medicine container with the marking device attached, according to an embodiment of the present invention.

Now in reference to FIGS. 7-8 and in accordance with one embodiment, the medicine container 112" may be provided as a conventional square or rectangular pill dispenser and segregated, by way of at least one optional internal partition 117 to contain different medicines or substance content. The medicine dispensing record system 100 may include a multiplicity of shapes and dimensions to correlate and join with the eclectic variety of medicine containers 112". In one embodiment, the height and circumference of the medicine container 112" may be sufficient to contain one months' worth of standard 15×15×7 millimeter pills. However, in other embodiments, variably sized pills, different supplies of the medicine, or liquid medicine may be utilized. It will be further understood that the medicine containers 112" of FIGS. 7-8 may be provided with a plurality of partitions 117 disposed within hollow interior of the medicine container 112" and defining internal compartments 117' and a plurality of identification means 110, so as to identify contents or substances within each respective internal compartment 117'. Although, the record system 100 has been shown as occupying only a portion of the medicine container 112", it may be configured for attachment to the entire surface thereof, for example by the afore described adhesive 132 or any other suitable fastener. In this manner, the marking surface 118 will generally cover the surface of the medicine container 112" and will essentially define the entire system 100. In this embodiment, the optional member 116, shown as being inset or indented into the surface, will essentially define a periphery of the top surface (as viewed in FIG. 7) of the medicine container 112".

Alternatively, the medicine container 112" may be provided as a box package, generally thin and disposable in use, containing blister packs of medicines like Benadryl or cold medicine.

In some embodiments, the medicine dispensing record system 100 may be designed to permanently affix, or detachably attach to the container 112, 112', 112" and record and display content and administration information about the medicine to ensure the proper administration of the medicine. The medicine information that is recorded may be erased and updated when a subsequent dose of medicine is administered. Details of the installation of the medicine dispensing record system 100 are illustrated in FIGS. 1 through 8. In operation, the user would have a malady that required the use of the medicine. The user would receive a medicine container 112, instructions about the medicine and the proper administration of the medicine from a medical professional or medicine container directions. The user would administer the appropriate dosage of the medicine. The identification portion 110 would rest over an aperture in the medicine container 112. In one embodiment, the identification portion 110 includes a threaded surface for engaging a threaded aperture of the medicine container 112, 112' and 112". The identification portion 110 would rotatably secure to the medicine container 112, 112' and 112". Immediately after dispensing the medication, the user would utilize the marking device 122 to mark the time, quantity, and instructions regarding the administration of the medicine. The marking device 122 would inscribe the medicine information onto the marking surface 118. If limited visibility is a factor, the protruding member 116 could be utilized as a guide to identify the marking surface 118.

At a predetermined periodic interval, the user would require an additional dosage of the medicine and detach the identification portion 110 from the medicine container 112, 112' and 112". The user would administer an additional dosage of medicine based on the medicine instructions displayed on the marking surface 118. The previous medicine instructions would be erased by rubbing or removed when the identifier 120 is provided as a peelable member. A cloth, an all-in-one dry erase marker with a dry eraser, or a hand may be utilized for erasing the medicine instructions. The user would mark new medicine instructions on to the marking surface 118 to reflect the most recent administration of the medicine. The process of erasing and adding additional medicine instructions onto the marking surface 118 would then be repeated every time a subsequent dosage of medicine was administered. In one embodiment, the indicia 115 "Last Dose Given" may be written on the marking surface 118, since this term is well known in the medical professional field and refers to the time and date that the last dose of medication was given.

Although the present invention has been shown and described in combination with a medicine container, it will be apparent to those skilled in the art, that the present invention may be applied to other containers employed for storing any substance such as dry or wet ingredients and/or fluids. By way of one example only, the record system 100 may be employed to record an expiration date of such substance. By way of another example, the record system 100 may be employed to record type and/or quantity of the substance container therewithin. In these examples, the indicia 115 may be an optional element configured for a particular application. Unless specifically stated otherwise, and as may be apparent from the following description and claims, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. In a combination with a container, a record system comprising:

(a) an identification portion positioned to close an open end of the container;

(b) a marking surface disposed on or within the identification portion, the marking surface configured to receive an identifier thereon without binding and/or being absorbed by the marking surface;

(c) a surface indentation in a side wall of the container; and (d) a marking device disposed within the indentation and operable to adhere the identifier to the marking surface.

2. The record system of claim 1, further including a fastener disposed within the surface indentation and being configured to attach the marking device to the container.

3. The record system of claim 1, wherein the marking device comprises an all-in-one marking device with an eraser on one end.

4. The record system of claim 1, wherein the identification portion comprises a detachable cap or lid.

5. The record system of claim 1, wherein the identification portion comprises a perimeter lip configured to engage the open end of the container.

6. The record system of claim 5, wherein the perimeter lip is configured to engage a threaded wall of the open end of the container for detachable attachment thereto.

7. The record system of claim 5, further including indicia disposed on a side surface of said perimeter lip.

8. The record system of claim 1, wherein the identification portion further comprises an annular member protruding above the marking surface.

9. The record system of claim 8, further including indicia disposed on a side and/or edge surface of said protruding annular member.

10. The record system of claim 1, wherein the container includes a bottle configured to hold medicine therewithin and wherein the identification portion comprises a perimeter lip configured to engage an exterior surface of a cap configured to selectively close the open end of the bottle.

11. The record system of claim 1, wherein the identifier comprises a nontoxic erasable ink.

12. The record system of claim 1, wherein the marking surface comprises a dry erase patch.

13. A content record system comprising:

(a) an identification portion including a protruding and/or inset member having a marking surface for receiving an identifier, the identifier being configured to adhere to the marking surface without binding or being absorbed by the marking surface;

(b) a marking device, the marking device being operable to adhere the identifier to the marking surface;

(c) a generally hollow container being configured to join with the identification portion, the container including a substantially cylindrical shape and having a longitudinal axis, the container further comprising an indentation positioned in alignment with the longitudinal axis, the indentation being configured to receive and hold the marking device, wherein the marking device is partially inset, forms a flush surface with a surface of the container or partially extends beyond the surface of the container when positioned inside the indentation; and (d) the content record system configured to record information about a content within the container and/or ensure proper dispensing and/or use of the content within the container.

14. A content record system comprising:

a container having an open top;

an identification portion positioned to close the open top of the container and comprising a perimeter lip configured to engage a side surface of the container adjacent the open end thereof;

a marking surface disposed on or within the identification portion, the marking surface configured to receive an identifier thereon without binding and/or being absorbed by the marking surface;

a peripheral annular member upstanding on the marking surface;

a surface indentation in a side wall of the container;

a marking device disposed within the indentation and operable to adhere the identifier to the marking surface; and a fastener disposed within the surface indentation and being configured to attach the marking device to the container.

* * * * *